United States Patent [19]

Kingery

[11] Patent Number: 4,981,067

[45] Date of Patent: Jan. 1, 1991

[54] REACTIVED ARMOR IMPROVEMENT

[75] Inventor: Charles N. Kingery, Aberdeen, Md.

[73] Assignee: The United States of America as represented by the Secretary of the Army, Washington, D.C.

[21] Appl. No.: 408,980

[22] Filed: Sep. 18, 1989

[51] Int. Cl.[5] ..... F41H 5/07

[52] U.S. Cl. ..... 89/36.17; 109/36

[58] Field of Search ..... 89/36.02, 36.17; 109/36, 37, 80, 81, 82

[56] References Cited

U.S. PATENT DOCUMENTS

| | | | |
|---|---|---|---|
| 3,736,838 | 6/1973 | Butterweck et al. | 89/36.02 |
| 4,044,599 | 8/1977 | Goldstein et al. | 102/701 |
| 4,368,660 | 1/1983 | Held | 89/36.17 |
| 4,398,446 | 8/1983 | Pagano et al. | 89/36.17 |
| 4,545,286 | 10/1985 | Fedij | 89/36.02 |
| 4,741,244 | 5/1988 | Ratner et al. | 89/36.17 |
| 4,824,624 | 4/1989 | Palicka et al. | 89/36.02 |

FOREIGN PATENT DOCUMENTS

| | | | |
|---|---|---|---|
| 209221 | 1/1987 | European Pat. Off. | 89/36.02 |
| 2191276 | 12/1987 | United Kingdom . | |
| 2192697 | 1/1988 | United Kingdom . | |
| 2200437 | 8/1988 | United Kingdom . | |

*Primary Examiner*—Stephen C. Bentley

*Attorney, Agent, or Firm*—Saul Elbaum; Paul S. Clohan

[57] ABSTRACT

An apparatus for protecting a surface from a projectile having a series of reactive armor plates disposed substantially adjacent to one another and substantially covering the surface to be protected. The reactive armor plates each have an upper inert plate having a front planar surface and a back planar surface, a lower inert plate having a front planar surface and a back planar surface and a high explosive having a front planar surface and a back planar surface sandwiched between the upper inert plate and the lower inert plate. The upper inert plate has a plurality of holes between it's front planar surface and it's back planar surface and the lower inert plate also has a plurality of holes between it's front planar surface and it's back planar surface.

8 Claims, 1 Drawing Sheet

REACTIVED ARMOR IMPROVEMENT

RIGHTS OF THE GOVERNMENT

The invention described herein may be manufactured, used and licensed by or for the United States Government for Governmental purposes without payment to us of any royalty thereon.

BACKGROUND OF THE INVENTION

The present invention relates to reactive armor for military vehicles such as tanks and armored personnel carriers. In particular, this invention relates to an improved means for protecting the surface area of the vehicle from attack and penetration of it's armor by various types of anti-armor projectiles.

In a military combat environment it is essential for the driver and occupants of land and sea vehicles to be protected from modern anti-armor projectiles. In general there are three types of anti-armor projectiles: kinetic energy projectiles, projectiles with shaped charge warheads, and projectiles with high explosive warheads. The kinetic energy projectile consists of a small subcaliber projectile of high density material launched from a gun tube by a sabot carrier and accelerated to supersonic velocity. This type of projectile does not have an explosive warhead but due to its high density and speed it easily penetrates unprotected armor and causes considerable damage to the vehicle by ricocheting off interior walls. In the shaped charge warhead, the projectile strikes the exterior armor causing a high explosive charge to collapse a metallic liner and form a high speed jet which then penetrates even very thick armor. In high explosive warheads, a high explosive charge detonates upon impact with the exterior armor causing damage by concussion or blast fragmentation.

The most effective armor available to defeat shaped charge warheads is reactive armor. Reactive armors are armors which contain explosives which react in response to the impact of the shaped charge jet, causing the jet to dissipate its energy prior to penetration of the hull armor. The principal type of reactive armor currently available is an explosive sandwiched between two plates of inert material. The present invention presents an improvement on this type of reactive armor.

OBJECTS AND SUMMARY OF THE INVENTION

A primary object of the invention is to reduce the mass of the reactive armor protection without reducing its effectiveness.

Another object of the invention is to reduce the amount of explosive within the reactive armor thereby reducing the damage to other nearby reactive armors during activation.

The objects stated above are accomplished by providing a series of rectangular shaped armor plates, or plates of suitable other shape, placed approximately adjacent each other over crucial areas of the vehicle's armor surface. The armor plate is connected to the vehicle's armor surface by conventional means which are well known in the prior art, and spaced above the vehicle's armor surface an appropriate distance. The reactive armor plate comprises three separate components; an upper inert plate, a lower inert plate, and a high explosive sandwiched between the upper inert plate and the lower inert plate. The inert plates may be made from iron, steel or other suitable materials such as aluminum or ceramics. The plates may be as much as a half inch or more in thickness. The plates have a front planar surface and a back planar surface, both planar surfaces are parallel to one another. The high explosive sandwiched between the two plates may be DuPont DETASHEET (a mixture by weight of 63% pentaerythritol tetranitrate (PETN), 8% nitrocellulose, and 29% acetyltributylcitrate (ATBC)), Composition C (88.3% RDX (Cyclonite) and 11.7% non-explosive plasticizer), or any other suitable explosive. The plates are perforated with a number of holes between the planar surfaces. The high explosive sandwiched between the plates may or may not be perforated, depending upon the particular application. The perforation of the plates and explosive allows the reactive armor to have as much as fifty percent less mass than prior art reactive armor plates, and the mass of the high explosive may also be reduces by as much as fifty percent without reducing the effectiveness of the reactive armor plate. Also, with less reactive armor mass, there is less potential damage to the armored hull of the vehicle and less damage to adjacent reactive armor plates.

DETAILED DESCRIPTION OF THE PREFERRED EMBODIMENTS

Figure 1:
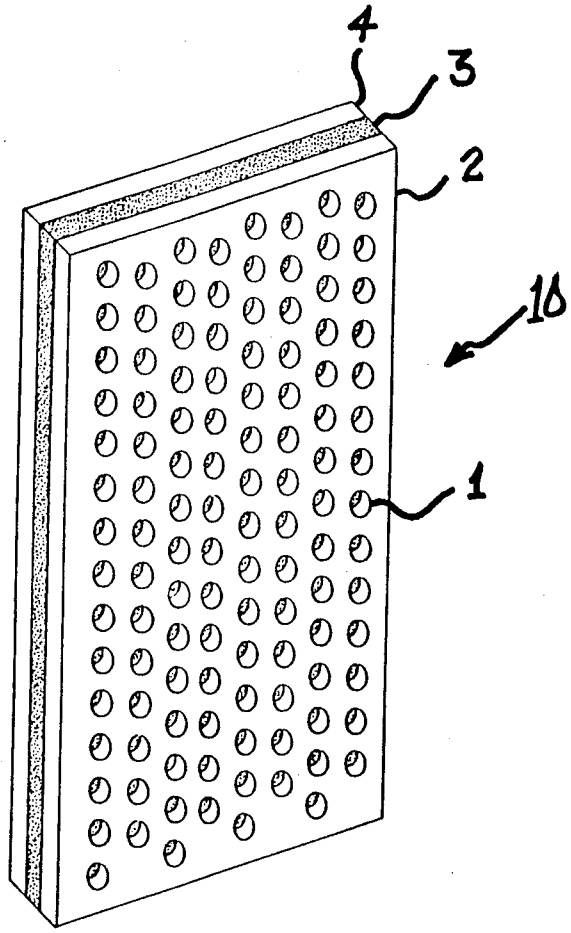
FIG. 1 is a perspective view of a single reactive armor plate.

Referring now to FIG. 1, a reactive armor plate 10 according to the present invention is shown. An upper inert plate 2, having a plurality of holes 1 disposed between the plates front planar surface and back planar surface, is bonded to a high explosive 3, which is also bonded to lower inert plate 4. Although high explosive 3 is shown in FIG. 1 as a solid sheet, high explosive 3 can be perforated with holes in a manner similar to plate 2. Although not shown, lower inert plate 4 also has a plurality of holes between it's front planar surface and it's back planar surface. The number of holes in plate 2 should be the same as the number of holes in plate 4, although the holes do not necessarily have to be coaxially aligned. The number of holes in plates 2 and 4 will depend upon the particular application involved; typically enough holes are provided to remove from 10 to 50 percent of the mass of the plate. The same is true of explosive 3.

As in the prior art, reactive armor plate 10 is placed adjacent to similarly constructed reactive armor plates to form a larger reactive armor surface over the vehicle to be protected. The technique of spacing and mounting reactive armor plates is well known in the prior art and will not be shown here.

To those skilled in the art, many modifications and variations of the present invention are possible in light of the above teachings. It is therefore to be understood that the present invention can be practiced otherwise than as specifically described herein and still will be within the spirit and scope of the appended claims.

I claim:

1. A device for protecting a surface from a projectile comprising:

a series of reactive armor plates disposed substantially adjacent to one another but not overlapping and substantially covering the surface to be protected, said series of reactive armor plates mounted above said surface to be protected;

said reactive armor plates each comprising an upper inert plate having a front planar surface and a back planar surface, a lower inert plate having a front planar surface and a back planar surface and a high explosive having a front planar surface and a back planar surface disposed between said upper inert plate and said lower inert plate;

said upper inert plate having a plurality of small holes between said front planar surface and said back planar surface and said lower inert plate having an equal plurality of small holes between said front planar surface and said back planar surface, said plurality of small holes on said upper inert plate and said plurality of small holes on said lower inert plate substantially uniformly spaced throughout thereby reducing the mass of said reactive armor plate in a uniform manner by 10 to 50%.

2. The device of claim 1 wherein said high explosive has a plurality of small holes equal to that of said upper insert plate between said front planar surface and said back planar surface, said plurality of small holes disposed on said high explosive substantially uniformly spaced throughout thereby reducing the mass of said explosive by 10–50%.

3. The device of claim 1 wherein said upper inert plate and said lower inert plate is made from iron.

4. The device of claim 1 wherein said upper inert plate and said lower inert plate is made from steel.

5. The device of claim 1 wherein said upper inert plate and said lower inert plate is made from aluminum.

6. A device for protecting a surface from a projectile comprising:

a series of reactive armor plates disposed substantially adjacent to one another but not overlapping and substantially covering the surface to be protected, said series of reactive armor plates mounted above said surface to be protected;

said reactive armor plates each comprising an upper inert plate having a front planar surface and a back planar surface, a lower inert plate having a front planar surface and a back planar surface and a high explosive having a front planar surface and a back planar surface disposed between said upper inert plate and said lower inert plate;

said upper inert plate and said lower inert plate made from ceramic;

said upper inert plate having a plurality of small holes between said front planar surface and said back planar surface and said lower inert plate having an equal plurality of small holes between said front planar surface and said back planar surface, said plurality of small holes on said upper inert plate and said plurality of small holes on said lower inert plate substantially uniformly spaced throughout thereby reducing the mass of said reactive armor plate in a uniform manner by 10 to 50%.

7. The device of claim 1 wherein said high explosive consists of DuPont DETASHEET, a mixture by weight of 63% pentaerythritol tetranitrate (PETN), 8% nitrocellulose, and 29% acetyltributylcitrate (ATBC).

8. The device of claim 1 wherein said high explosive consists of Composition C.

* * * * *